United States Patent [19]

Hashimoto

[11] 4,111,179

[45] Sep. 5, 1978

[54] CATAPULT TOY

[76] Inventor: Hideo Hashimoto, 2618 Desert St., P.O. Box 1182, Rosamond, Calif. 93560

[21] Appl. No.: 785,686

[22] Filed: Apr. 7, 1977

[51] Int. Cl.[2] ..... F41B 3/02; F41B 7/00

[52] U.S. Cl. ..... 124/7; 124/17

[58] Field of Search ..... 124/7, 36, 41 R, 6, 124/8, 16, 80, 1, 17; 273/95 R, 96 R, 97 R, 98, 101

[56] References Cited

U.S. PATENT DOCUMENTS

| | | | |
|---|---|---|---|
| 216,590 | 6/1879 | Wright | 124/7 |
| 221,021 | 10/1879 | Beck | 124/7 UX |
| 2,658,495 | 11/1953 | Elliott | 124/7 |

FOREIGN PATENT DOCUMENTS

| | | | |
|---|---|---|---|
| 2,426 of | 1876 | United Kingdom | 124/7 |
| 332,321 | 7/1930 | United Kingdom | 124/7 |

*Primary Examiner*—Richard C. Pinkham
*Assistant Examiner*—William R. Browne
*Attorney, Agent, or Firm*—Criddle, Thorpe & Western

[57] ABSTRACT

A catapult toy includes a base plate, a mounting platform swivelably mounted on the base plate, a pair of arches positioned in a side-by-side relationship on the mounting platform at one end thereof to define an arching guide therebetween, a pivot arm pivotally mounted between the arches to move generally in a vertical plane in the arching guide, a cup disposed on the free end of the pivot arm for carrying a projectile, and a stop element attachable to the arches to bridge the arching guide at various locations therealong and thereby serve to stop upward movement of the pivot arm. Also included are a pair of upright standards mounted on the mounting platform on each side of the vertical plane in which the pivot arm moves, and an elastic band mounted on the upright standards to extend therebetween underneath the pivot arm. Finally, a latch is provided to hold the pivot arm in a latched position in which the arm is stretching or biasing the elastic band. The latch is operable to release the pivot arm so that the elastic band causes the pivot arm to move upwardly until it contacts the stop element at which time the projectile carried by the cup is thrown out of the cup.

6 Claims, 2 Drawing Figures

CATAPULT TOY

BACKGROUND OF THE INVENTION

This invention concerns a catapult toy adapted to propel projectiles through the air.

Catapult-type toys are fairly well known in the prior art as evidenced, for example, by U.S. Pat. Nos. 243,222, 1,051,470, 2,834,331, 2,878,801 and 3,517,656. These prior art arrangements typically involve the use of a resilient capapult arm which may be tensioned so that when released, the arm will throw a projectile in some desired direction. With the described arrangements, it can be expected that with time the resilient catapult arms would fatigue, become deformed, or otherwise lose their ability to function. This, of course, would necessitate either a replacement of the arm or a replacement of the entire catapult device. The prior art arrangements are also generally adapted to propel the projectile at only one trajectory elevation, i.e., to release the projectile at the same point in the sweep or excursion of the catapult arm.

It is an object of the present invention to provide a versatile and yet inexpensive catapult toy.

It is another object of the present invention to provide such a toy for propelling a projectile, with the toy including apparatus for enabling variation in the trajectory elevation, i.e., variation in projectile release angles, and the speed at which the projectile is propelled.

It is a further object of the present invention to provide a catapult toy in which the operative part of the toy for causing movement of the catapult arm may be readily replaced when worn.

SUMMARY OF THE INVENTION

The above and other objects of the present invention are realized in an illustrative embodiment thereof comprising a mounting platform, a pair of arch members positioned in a contiguous relationship on the mounting platform to define an arching slot therebetween, a pivot arm mounted at one end thereof on the mounting platform between the arch members so that the pivot arm is movable generally in a vertical plane in the arching slot, a cup disposed on the other end of the pivot arm for carrying a projectile, a stop element disposed on the arch members to extend therebetween across the arching slot above the pivot arm for stopping upward movement of the arm, a pair of upright standards mounted on the mounting platform on each side of the vertical plane in which the pivot arm moves, and an elastic band extending between the standards underneath the pivot arm to provide a force for causing the arm to move upwardly. A latch is also provided for releasably latching the pivot arm in a position in which the pivot arm is held against the band to stretch it so that when the arm is released, it is propelled upwardly by the band. The band may be positioned at various elevations on the standards to vary the force operating on the pivot arm and the stop element may similarly be positioned at various locations along the arching slot to thereby vary the release angle or trajectory elevation of the projectile from the arm.

BRIEF DESCRIPTION OF THE DRAWINGS

The objects, features and advantages of the present invention will become apparent from a consideration of the following detailed description presented in connection with the accompanying drawings in which.

DETAILED DESCRIPTION

Figure 1:
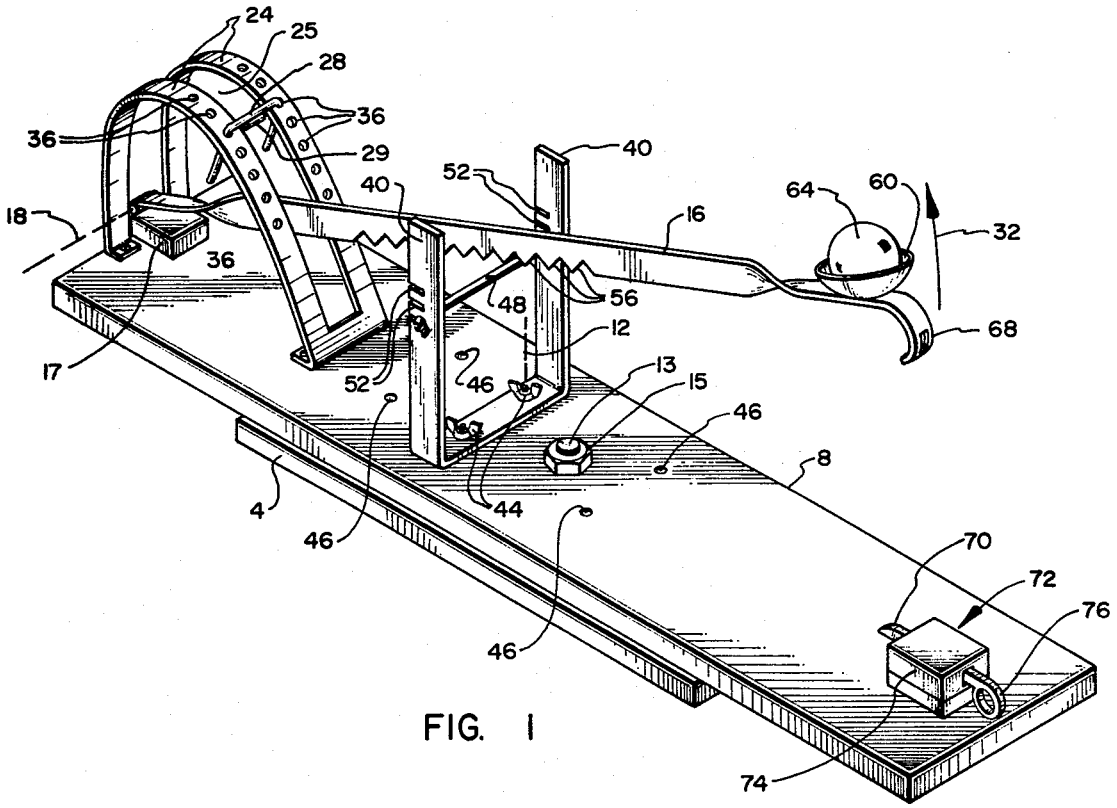
FIG. 1 is a perspective view of a catapult toy made in accordance with the principles of the present invention.

Referring to the drawings there is shown a catapult toy which includes a base member 4 and a mounting platform 8 mounted on the base member to swivel or rotate generally in a horizontal plane about a pivot axis 12. Advantageously, the mounting platform is positioned on a bolt 13, which extends upwardly from the base member 4, and on a washer or washers 14 disposed on the bolt. A nut 15 is screwed onto the bolt 13 to hold the mounting platform 8 on the base member 4. The mounting platform 8 provides a support for the remaining elements of the toy.

Located at one end of the mounting platform 8 are a pair of arch members 24 positioned in a side-by-side relationship to define an arching slot 25 therebetween. The arch members 24 may be mounted on the mounting platform 8 by any suitable attachment method including nuts and bolts, adhesive, etc.

Figure 2:
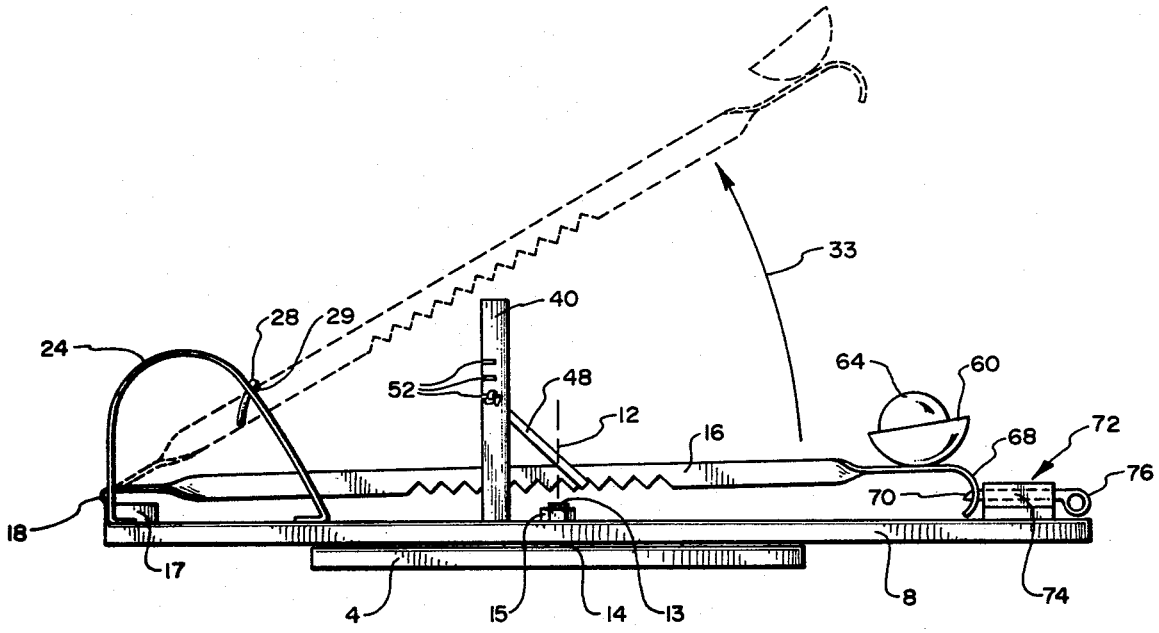
FIG. 2 is a side elevational view of the catapult toy of FIG. 1 showing the pivot arm in a latched position and indicating pivotal movement of the arm.

The arching slot 25 between the arch members 24 defines a guide in which a pivot arm 16 is to move. The pivot arm 16 is pivotally mounted at one end thereof to a mounting block 17 located at the base of and between a contiguous pair of legs of the arch members 24. The pivot arm 16 is mounted to pivot in a generally vertical plane about a generally horizontal pivot axis 18. The movement of the pivot arm 16 is indicated by arrows 32 and 33 of FIGS. 1 and 2.

A stop element 28 is disposable on the arch members to extend therebetween across the arching slot 25 and thus act to stop the upward movement of the pivot arm 16. The stop element 28 is comprised of a piece of generally U-shaped wire having two legs insertable in openings 36 spaced along the arch members and paired on either side of the arching slot 25. Provision of a plurality of openings 36 in the arch members enables positioning of the stop element 28 at different locations along the arching slot 25 to thereby stop the upward movement of the arm at different angles or elevations thereof. Advantageously, a pad 29 is attached to that portion of the stop element 28 which bridges the arching slot 25 for cushioning the striking of the stop element by the pivot arm 16.

A pair of upright standards 40 are mounted on the mounting platform 8 on either side of the vertical plane in which the pivot arm 16 moves. The upright standards 40 may be formed of a generally U-shaped support with the bottom of the support mounted by wing nuts and bolts 44 to the mounting platform 8. Alternatively, two separate upright standards 40 could be embedded in the mounting platform 8. The upper end of each of the standards 40 is provided with a plurality of longitudinally spaced slits extending laterally in the standards. These slits are provided for receiving and holding opposite ends of an elastic band 48. The elastic band 48, of course, may be positioned at various elevations in the different slits 52.

As indicated earlier, the upright standards 40 are part of a U-shaped support which is mounted at the bottom thereof on the mounting platform 8. Provision of additional openings 46 in the mounting platform 8 enables mounting the upright standards 40 either closer toward or further away from the arch members 24. That is, the wing nuts and bolts 44 can simply be removed from one pair of openings 46 and then moved to another pair to there secure the upright standards.

The bottom edge of the pivot arm 16 includes a plurality of inverted V-shaped notches 56 which are dimensioned to receive the elastic band 48 thereinto and prevent the sliding of the band along the bottom of the pivot arm. A cup 60 is mounted on the end of the pivot arm opposite the end mounted on the block 17 for holding a ball 64 or other projectile. Also included on the end of the pivot arm 16 is a latch plate 68 having an opening therein for receiving a latch bolt 70 of a latch 72 mounted on the mounting platform 8. The latch bolt 70 is spring biased out of a latch housing 74 in the conventional manner so that when the pivot arm 16 is lowered a sufficient distance, the latch plate 68 slides over the end of the latch bolt 70 forcing it into the housing 74 until the opening in the latch plate 68 is aligned with the latch bolt 70 at which time the latch bolt moves into the opening to latch and hold the pivot arm in a so-called latched position. The latch bolt 70 extends through the housing 74 with the other end of the latch bolt being formed into a handle 76 for grasping. Pulling the handle outwardly of the housing 74, of course, causes retraction of the latch bolt 70.

To prepare the catapult toy for use, the elastic band 48 is positioned at the desired elevation in the slits 52. To achieve greater range, i.e., greater force upon the pivot arm 16, the elastic band 48 would be positioned in the topmost pair of slits 52, whereas for a shorter range, the elastic band would be positioned in the lowermost slits. Additionally, positioning the upright standards 40 closer to the arch members 24 increases the range of the projectile whereas positioning the upright standards farther from the arch members 24 descreases the range. After positioning the standards and the elastic band where desired, the pivot arm 16 is forced downwardly to stretch the elastic band until the latch plate 68 aligns with the latch bolt 70 so that the latch bolt moves into the opening in the latch plate 62 to latch the pivot arm 16 in the latched position.

The stop element 28 may then be positioned at the desired location along the arch members 24. Positioning the stop element 28 at a lower elevation toward the pivot arm 16 will result in the pivot arm being stopped very early in its excursion so that the projectile 64 is thrown out of the cup 60 at a fairly high angle. Alternatively, positioning the stop element 28 at a higher elevation and further from the pivot arm 16 results in the pivot arm being stopped much later in its excursion so that the projectile 64 is released later and at a lower angle.

The pivot arm is released by simply pulling the latch bolt 70 into the housing 74 and thus out of the latch plate 68. The stretched elastic band 48, of course, forces the pivot arm 16 upwardly until the pivot arm strikes the stop element 28 at which time the projectile 64 is thrown from the cup 60. The direction in which the projectile is thrown can be controlled by swiveling the mounting platform 8 to point in the desired direction.

It is to be understood that the above described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A catapult toy comprising a mounting platform, a pair of arch members positioned in a contiguous relationship on said mounting platform at one end thereof to define an arching slot therebetween, a pivot arm pivotally mounted at one end thereof on said mounting platform between said arch members, said pivot arm being movable generally in a vertical plane in said arching slot between a latched position and a stop position, and including a plurality of notches located on the underneath side of the arm, cup means disposed on the other end of said pivot arm for carrying a projectile therein, stop means disposed on said arch members to extend therebetween across said arching slot above said pivot arm for stopping upward movement of the arm, said stop mens being positionable at different locations along the arching slot to thereby stop the upward movement of the arm at different elevations of the arm, a pair of upright standards mounted on said mounting platform on each side of the vertical plane in which said pivot arm moves, an elastic band extending between said standards underneath said pivot arm to contact and urge the arm upwardly when the band is stretched by downward movement of the arm against the band, said band being positionable in various ones of the notches of said pivot arm to thereby vary the force applied by the band to the arm, and latch means for releasably latching the pivot arm in a latched position in which the band is stretched downwardly by the arm, said pivot arm being propelled upwardly by said band when released by the latch means.

2. The catapult toy of claim 1 wherein said arch members are formed of strips of material having a plurality of openings spaced along corresponding portions of the strips, and wherein said stop means comprises a generally U-shaped member formed to enable inserting the legs of the member into the opening in the strips so that the member bridges the arching slot.

3. The catapult toy of claim 2 wherein said stop means further comprises a pad means disposed on that portion of the U-shaped member which bridges the arching slot for cushioning the striking of the stop means by the pivot arm.

4. The catapult toy of claim 1 wherein said upright standards include a plurality of longitudinally spaced slits extending laterally in the standards for receiving and holding opposite ends of the elastic band, said elastic band thereby being disposable in various slits to vary the elevation thereof.

5. The catapult toy of claim 1 wherein said upright standards and said mounting platform are adapted to enable mounting the standards at variable distances from the arch members.

6. The catapult toy of claim 1 further including a base member, said mounting platform being swivably mounted on said base member to swivel generally in a horizontal plane.

* * * * *